US009504871B2

(12) United States Patent
Muñoz Saez

(10) Patent No.: US 9,504,871 B2
(45) Date of Patent: Nov. 29, 2016

(54) WALL STRUCTURE FOR EXERCISING AND ATTACHING FITNESS AND PHYSICAL ACTIVITY ELEMENTS

(71) Applicant: Cesar Juan Muñoz Saez, Barcelona (ES)

(72) Inventor: Cesar Juan Muñoz Saez, Barcelona (ES)

( * ) Notice: Subject to any disclaimer, the term of this patent is extended or adjusted under 35 U.S.C. 154(b) by 0 days.

(21) Appl. No.: 14/501,420

(22) Filed: Sep. 30, 2014

(65) Prior Publication Data

US 2015/0099613 A1 Apr. 9, 2015

(30) Foreign Application Priority Data

Oct. 3, 2013 (ES) ..... 201331127 U

(51) Int. Cl.

| | |
|---|---|
| ***A63B 9/00*** | (2006.01) |
| ***A63B 17/00*** | (2006.01) |
| ***A63B 71/00*** | (2006.01) |
| ***A63B 21/16*** | (2006.01) |
| *A63B 69/00* | (2006.01) |
| *A63B 21/055* | (2006.01) |

(52) U.S. Cl.

CPC ..... *A63B 21/16* (2013.01); *A63B 21/0555* (2013.01); *A63B 21/0557* (2013.01); *A63B 21/4035* (2015.10); *A63B 69/0048* (2013.01)

(58) Field of Classification Search

CPC ..... A63B 21/00; A63B 21/00079; A63B 21/00047; A63B 21/00083; A63B 21/00087; A63B 69/0048; A63B 21/16

USPC ..... 482/23, 35–37, 92, 139, 140, 142, 148

See application file for complete search history.

(56) References Cited

U.S. PATENT DOCUMENTS

| | | | | |
|---|---|---|---|---|
| 4,471,957 | A * | 9/1984 | Engalitcheff, Jr. | A63B 21/015 434/219 |
| 4,641,832 | A * | 2/1987 | Mattox | A63B 21/00065 482/114 |
| 5,389,055 | A * | 2/1995 | Gangloff | A63B 1/005 482/142 |
| 6,551,215 | B1 * | 4/2003 | Gordon | A63B 69/0048 472/134 |
| 7,608,029 | B2 * | 10/2009 | Weiss | A63B 1/00 482/130 |
| 7,780,576 | B1 * | 8/2010 | Sudeith | A63B 21/0552 482/129 |
| 7,819,778 | B1 * | 10/2010 | Sudeith | A63B 6/00 482/37 |
| 8,206,270 | B2 * | 6/2012 | Skipper | A63B 9/00 482/37 |
| 2005/0003938 | A1 * | 1/2005 | Henderson | A63B 21/068 482/143 |
| 2011/0319230 | A1 * | 12/2011 | Brendle | A63B 23/03541 482/37 |

* cited by examiner

*Primary Examiner* — Stephen Crow
*Assistant Examiner* — Garrett Atkinson
(74) *Attorney, Agent, or Firm* — Michael J. Striker

(57) ABSTRACT

A wall structure for exercising and attaching fitness and physical activity elements includes one or more modular panels configured to be fixed to a wall. The panels are configured receive at plurality of handles at various fixing positions distributed over a surface of the panel. Each panel has one more anchoring points distributed over the surface of the panel and configured for fixing accessory elements thereto.

8 Claims, 4 Drawing Sheets

WALL STRUCTURE FOR EXERCISING AND ATTACHING FITNESS AND PHYSICAL ACTIVITY ELEMENTS

CROSS-REFERENCE TO A RELATED APPLICATION

The invention described and claimed hereinbelow is also described in Spanish Patent Application U201331127 filed on Oct. 3, 2013. The Spanish Patent Application, the subject matters of which is incorporated herein by reference, provides the basis for a claim of priority of invention under 35 U.S.C. 119(a)-(d).

BACKGROUND OF THE INVENTION

The present invention broadly relates to a wall structure for exercising and attaching fitness and physical activity elements. The invention more particularly relates to a wall bar, of the type applicable for fixing to a wall, configured for quickly adding elements to carry out physical activity exercises, additionally allowing exercises to be carried out on the structure itself directly, and on the basis of modular panels provided with anchorings for attaching different accessory elements in addition to multiple handles that the user can grip with hands and feet to work directly on the structure.

In addition to convention conventional simple wall bars, which are known to consist of a structure of multiple horizontal bars, normally made of wood which, secured between vertical posts fixed to a wall, and disposed in parallel to each other at different heights, the market is also familiar with many other types of structures for carrying out fitness and physical exercises working vertically, some of which also are conceived to be able to attach accessory work elements.

These other types of structures, however, are not conceived to be placed on the wall and tend to consist of complex and voluminous constructions with a high financial cost which, moreover, in many cases constitute contraptions that are difficult to move and use, or which are not very versatile, therefore being almost exclusively conceived for use in gyms where there is a large amount of space available, making them impossible to adapt, for example, to a domestic space or small sports centres rehabilitation and recovery centre or directed activity and gym rooms which require polyvalent use of the space.

SUMMARY OF THE INVENTION

The present invention overcomes the shortcomings of known arts, such as those mentioned above.

To that end, the present invention provides a wall structure for exercising and attaching fitness and physical activity elements.

In an embodiment, the invention provides a structure applicable for fixing to a wall in the manner of a wall bar, for the purpose of providing a vertical work space for carrying out physical or fitness exercises and which in an innovative manner is configured on the basis of one or more modular panels which have been provided with a series of handles strategically distributed in rows and columns equidistant from the surface of the panel, so that the user can grip the handles with his/her hands and feet and be able to work directly on the wall bar in the same way as would be done on a conventional wall bar but with greater possibilities as there are multiple fixing points to the surface which, for example, allow the structure to be used to be able to carry out exercises and movements similar to those made when practicing climbing.

Preferably, the handles are formed on the basis of bar segments which are joined by two rods screwed to the surface of the panel, being fixed, preferably, although not by way of limitation, in a horizontal position thereon; in all events, leaving an intermediate space between the bars and the surface of the panel which allows multiple working options for the user with their hands or feet, since in addition to being able to grip them, the handles can be used as a step or as a cavity for inserting the arm, elbow, foot, ankle, etc.

At the same time, the modular panels are provided with several anchorings to allow, if wanted, additional work elements to be attached to the structure, such as ropes, bars, tensors, etc., providing the advantage of constituting a simple and quick, but especially safe, system, for fixing such elements making the structure a versatile work station.

Preferably, the anchorings consist of a base part which is joined in a fixed manner by screwing to the panel and in which perforations have been provided suitable for receiving a fastening and trim plate which, when it is of interest, can be engaged on it and which is provided with a ring and a through-hole for insertion in it, in turn, of the carabiners or anchorings of the accessory elements required for attaching to the panel.

The accessory elements for carrying out exercises may be of a widely varied nature from among all those existing on the market. Below some of the most common examples are cited, with the name used in their sector and their description, on the understanding that these do not represent a limitation of the scope of the invention:

- pull-up bar: for abdominal exercises;
- push-up bars: for push-up exercises;
- Russian belt: element for anchoring a muscle belt'
- Cardan cross: support for engaging a weightlifting bar or similar allowing 360° mobility;
- bar stand: element designed for storage of a weightlifting bar or similar;
- jump plate: platform for jumping; and
- rope puller: structure through which a rope is passed—the more tubes it passes through the more the friction surface, increasing the force required to make it slide from one end to the other.

The panel comprises a support frame and an outer plate that covers its top. The frame preferably consists of an iron framework and the base parts of the anchorings are screwed onto the frame directly. The frame is additionally provided with slotted holes to facilitate fixing to the wall by corresponding lag screw. For its part, the outer plate is preferably made of wood and covers the aforesaid frame by being fixed thereto by screwing and fixing the handles to it.

The inventive structure is designed so that, in addition to the specific functionality as a work station for attaching accessory elements for physical activity and fitness exercises and for carrying out exercises on it directly, it also represents an aesthetic and decorative element. As such, the inventive structure can be used for hanging and/or anchoring any type of object, including combining the position and number of modular panels that are convenient or required in each case, depending on the space available on the wall.

BRIEF DESCRIPTION OF THE DRAWINGS

Further features and advantages of the invention will become apparent from the description of embodiments that follows, with reference to the attached figures, wherein.

DETAILED DESCRIPTION OF THE PREFERRED EMBODIMENTS

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
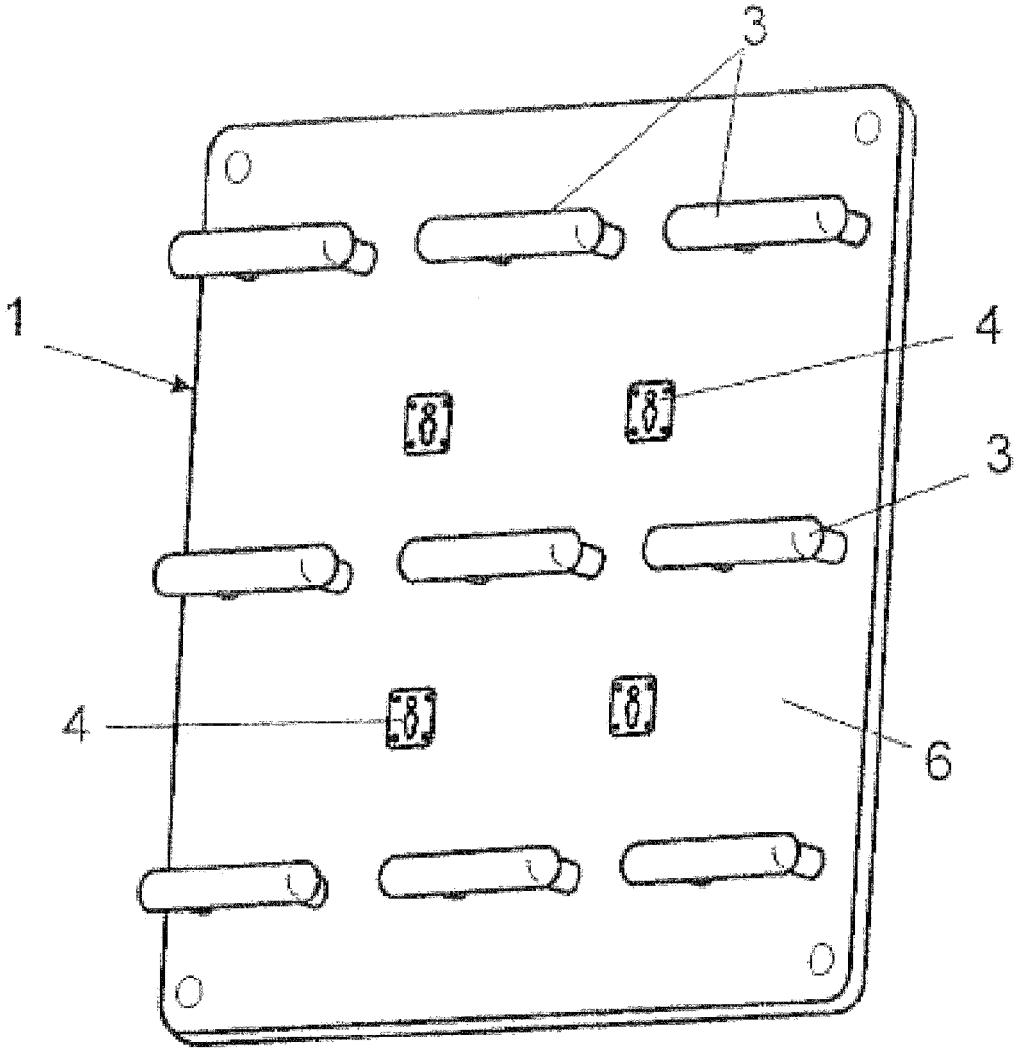
FIG. 1 is a perspective view of a panel constructed in accordance with the inventive principles.
Figure 2:
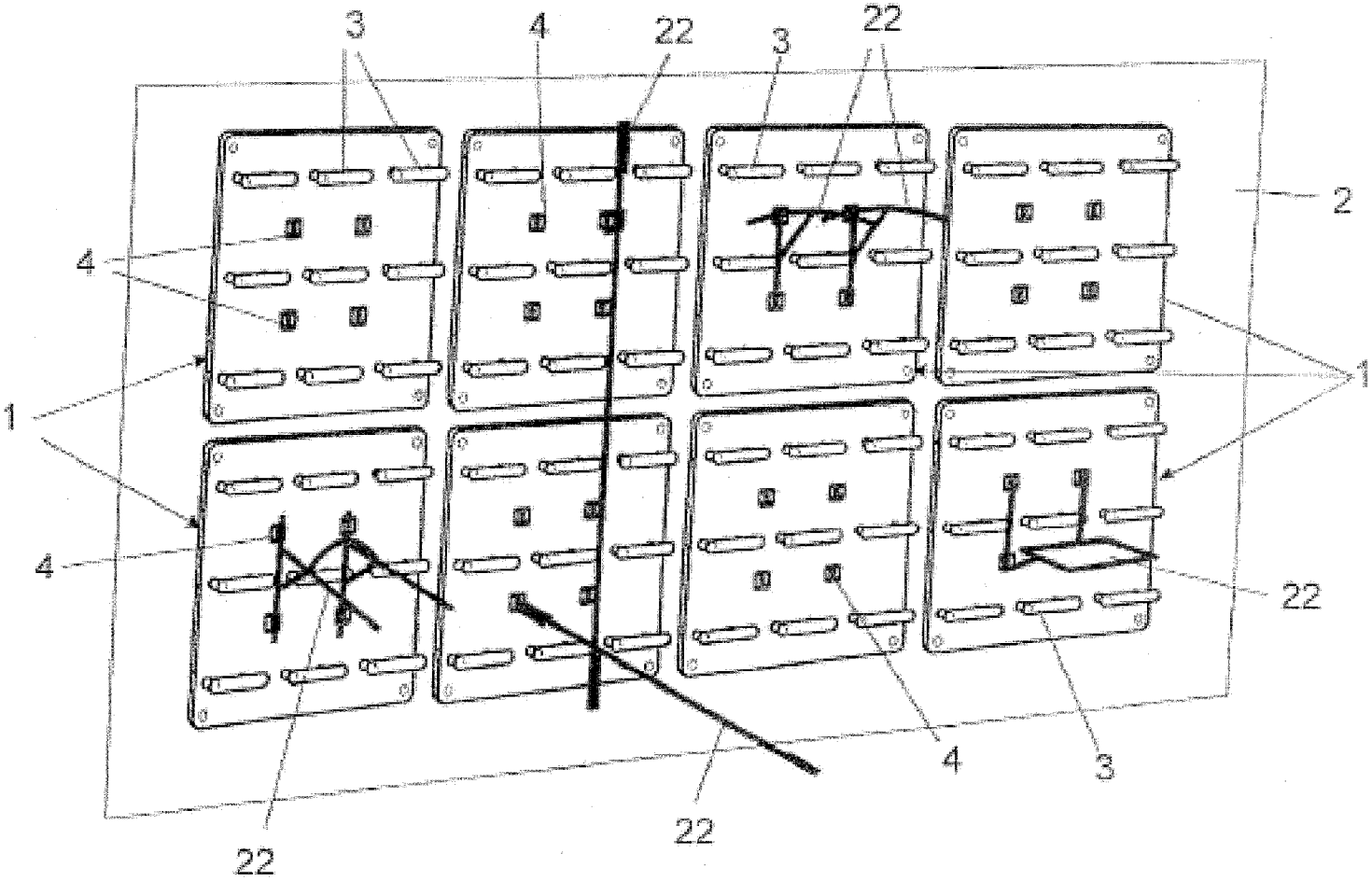
FIG. 2 is a front perspective view of a wall on which a wall structure for fitness has been installed, the wall structure formed by several of the panels to which accessory work elements are attached.

As shown in FIGS. 1 and 2, a wall structure of the invention is configured with at least one modular panel (1). The at least one modular panel (1) is intended to be fixed to a wall (2) and is provided with a plurality of handles (3) distributed in equidistant rows and columns on the panel surface. Between the handles, the panel incorporates several anchoring points (4) suitable for optionally fixing accessory work elements (22), such as ropes, bars, tensor bands, etc.

Figure 3:
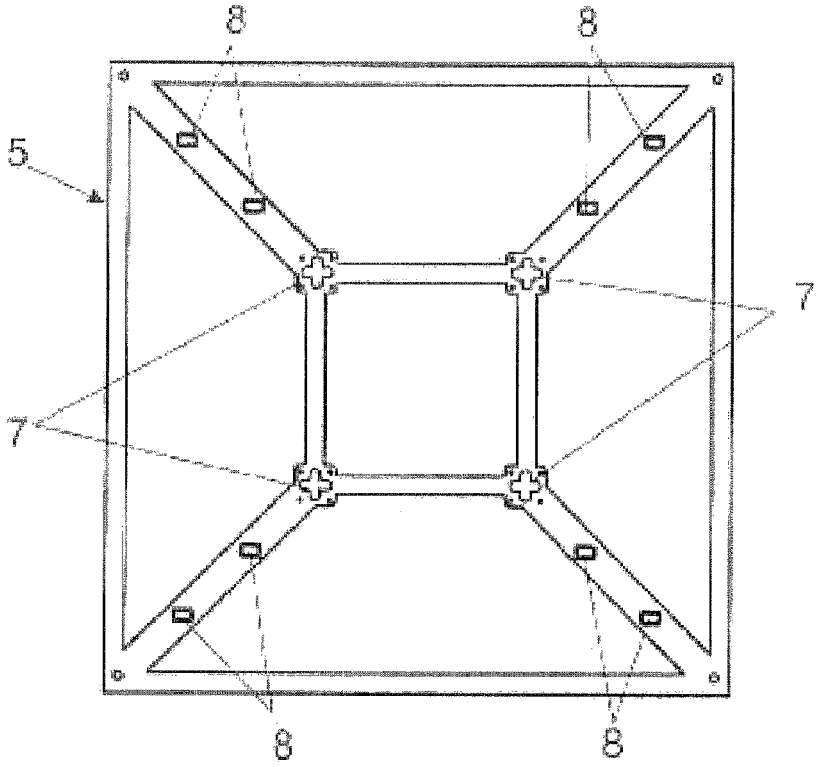
FIG. 3 is a front elevation view of a base frame portion of the panel.
Figure 4:
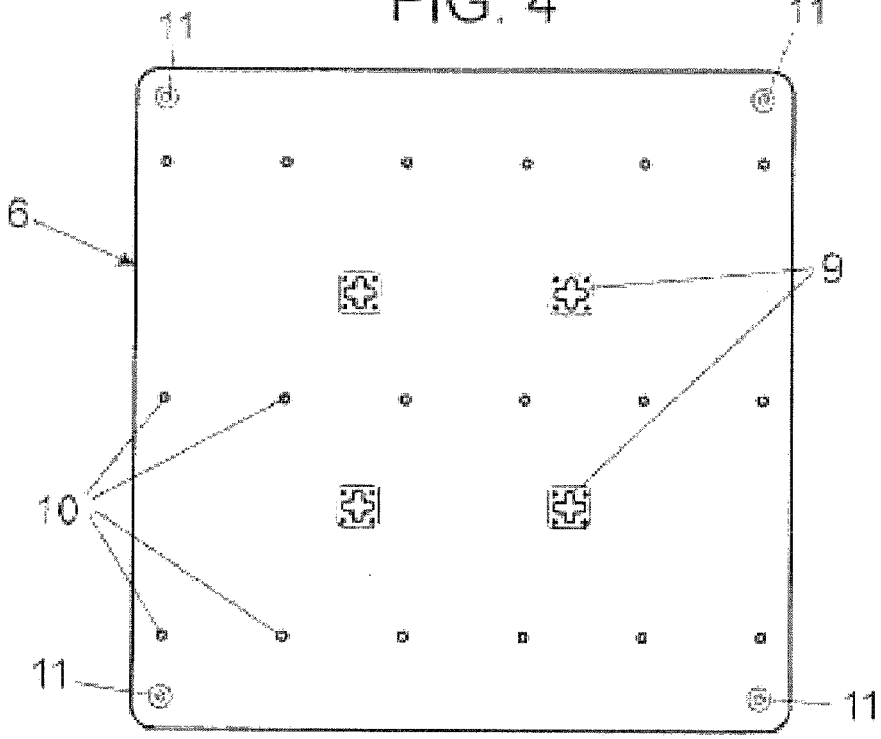
FIG. 4 is a front elevation view of an outer soffit of each panel for covering the base frame that forms the panel.

As can be seen in FIGS. 3 and 4, each panel (1) consists of a support frame (5) which is fixed to the wall (2) and an outer plate (6) which covers and embellishes it. The frame (5) is preferably a framework of iron tubes with reinforcement zones (7) suitable for receiving, fixed by screws, the anchoring points (4), with a series of slotted holes (8) for fixing this frame (5) to the wall (2).

The outer plate (6), which may be made of any suitably resistant material, for example wood, presents mortises (9) in which the anchorings (4) are inserted. The outer plate also includes a plurality of orifices (10) for fixing the handles (3) and is fixed to the frame (5) by at least four screws (11) provided in its corners.

Figure 5:
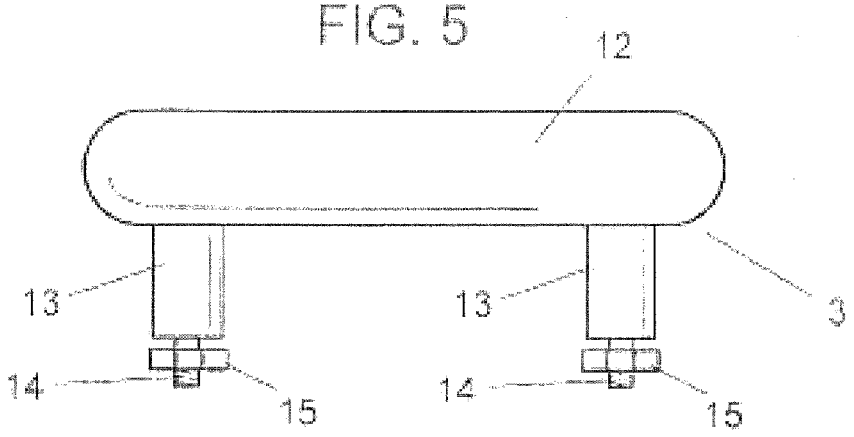
FIG. 5 is a view of one of the handles for use with the invention, the handle comprising a bar segment and rods.

FIG. 5 shows a handle (3) formed on the basis of bar segments (12) from which respective rods (13) emerge with threaded ends (14) for joining to the outer plate (6) of the panel by nuts (15) threaded on their rear part, leaving an intermediate space between the bar (12) and the surface of the plate (6) determined by the length of said rods (13).

Figure 6:
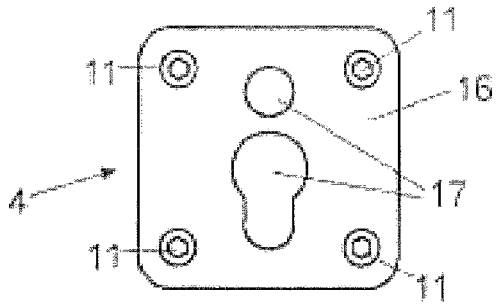
FIG. 6 is an elevation view of the base plates which constitute the anchorings of the panels.
Figure 7:
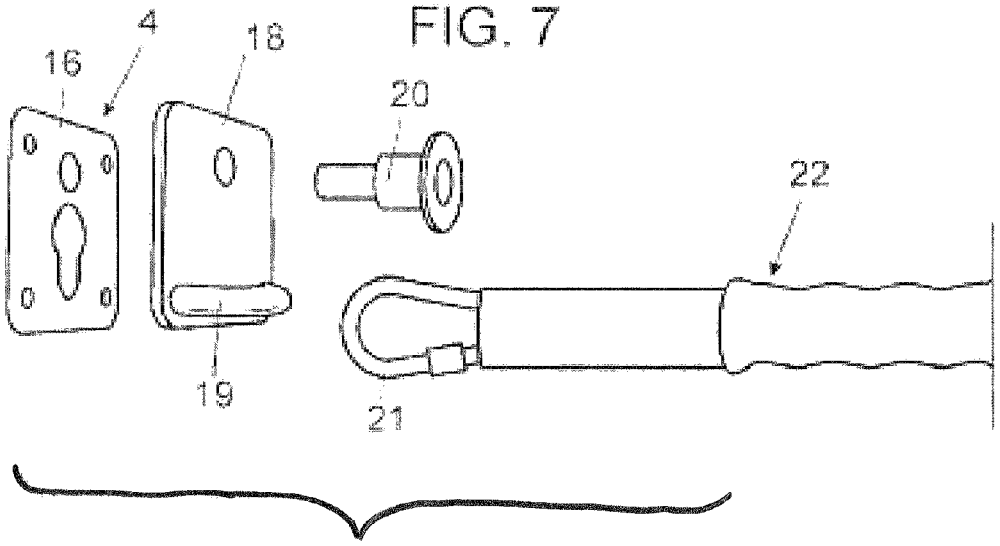
FIG. 7 is an exploded perspective view of a set of anchoring elements for fixing the accessory elements.

FIGS. 6 and 7 show an anchoring (4) comprising a metal base part (16), which is joined in a fixed manner by screws (11) to the frame (5) of the panel through the mortises (9) of the outer plate (6), and in which perforations (17) are provided for receiving and engaging the rear hook (not shown in the drawings) of a fastening plate (18). Fastening plate (18) is provided with a ring (19) or other means, such as the insertion of a pin (20) for fastening on it some carabiners (21) or other anchorings of the accessory elements (22) required for attaching to the panel.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A wall structure for exercising and attaching fitness and physical activity elements, comprising:

at least two modular panels, wherein each of the modular panels comprises an outer plate and is configured to be fixed to a wall;

a plurality of handles configured to be afixed at various fixing positions distributed over a surface of the outer plate of the at least two modular panels;

one or more anchoring points distributed over the surface of the outer plate of the at least two modular panels and configured for fixing accessory elements thereto; and a support frame for fixing each of the at least two modular panels to the wall, the support frame made up of a framework of tubes;

wherein the outer plate of each of the modular panels covers the respective support frame that fixes each of the modular panels to the wall; and wherein reinforcement zones are provided in the tubes of the support frame receiving anchorings, which are fixed by screws to form the anchoring points.

2. The structure according to claim 1, wherein the framework of tubes is made of iron.

3. The wall structure according to claim 1, wherein slotted holes are provided in the support frame for fixing the support frame to the wall.

4. The wall structure according to claim 1, wherein the outer plate includes mortises into which the anchorings are inserted.

5. The wall structure according to claim 1, wherein the handles are formed with bar segments from which respective rods emerge with threaded ends for joining to the panel using nuts threaded on a rear part, leaving an intermediate space between the respective bar segments and the surface of the plate determined by a length of the rods when the handles are joined to the panel.

6. The wall structure according to claim 1, wherein the anchorings comprise a base part made of metal, wherein the base part is joined by screws to the panel at each of the respective anchoring points and wherein the base part includes perforations for receiving and engaging a rear hook of a fastening plate.

7. The wall structure according to claim 6, wherein the fastening plate is provided with a ring, and wherein the accessory attachments are fixed to the ring and the pin, when the pin is inserted in the opening.

8. The wall structure according to claim 6, wherein the fastening plate includes an opening for receiving a pin, and wherein the accessory attachments are fixed to the ring and the pin, when the pin is inserted in the opening.

* * * * *